United States Patent [19]

Guionie et al.

[11] 4,069,547

[45] Jan. 24, 1978

[54] TOGGLE-TYPE DOOR STOP DEVICE IN PARTICULAR FOR AN AUTOMOBILE VEHICLE

[75] Inventors: Paul Guionie, Cublac; Ren Roudier, Brive, both of France

[73] Assignee: Paumellerie Electrique, France

[21] Appl. No.: 760,830

[22] Filed: Jan. 21, 1977

[30] Foreign Application Priority Data

Jan. 22, 1976 France ..... 76 01638

[51] Int. Cl.[2] ..... E05F 5/06

[52] U.S. Cl. ..... 16/85; 16/145; 16/147

[58] Field of Search ..... 16/85, 82, 86 C, 80, 16/128.1, 180, 188, 191, 71, 72, 145, 146, 147, 139; 109/63.5

[56] References Cited

U.S. PATENT DOCUMENTS

| | | | |
|---|---|---|---|
| 2,693,616 | 11/1954 | Cromwell et al. | 16/85 |
| 2,787,019 | 4/1957 | Galla | 16/85 |
| 2,860,369 | 11/1958 | Galla | 16/85 |
| 3,091,796 | 6/1963 | Leslie | 16/142 |
| 3,153,259 | 10/1964 | Brissette et al. | 16/142 |
| 3,370,318 | 2/1968 | Marchione | 16/145 |
| 3,605,174 | 9/1971 | Marchione | 16/145 |
| 3,710,417 | 1/1973 | Berman et al. | 16/180 |
| 3,837,040 | 9/1974 | Keller et al. | 16/145 |

*Primary Examiner*—Ronald Feldbaum

*Attorney, Agent, or Firm*—Robert E. Burns; Emmanuel J. Lobato; Bruce L. Adams

[57] ABSTRACT

The door stop device comprises two pivotally interconnected links for pivoting, one link, to a door and, the other link, to a fixed part on which the door is pivotally mounted. The links are capable of being unfolded and folded when opening and closing the door. A first link is extended beyond its pivotal connection to the other link by two semi-cams. Each of the semi-cams defines a stop notch. A cam follower movably mounted in the second link is capable of engaging the stop notches under the action of a spring in the second link to create a retention in the course of the unfolding of the links. This retention may be overcome to permit the return of the links to their folded position.

19 Claims, 9 Drawing Figures

TOGGLE-TYPE DOOR STOP DEVICE IN PARTICULAR FOR AN AUTOMOBILE VEHICLE

The present invention relates to a toggle-type door stop device, in particular for an automobile vehicle comprising two links which are adapted to be respectively pivoted to a fixed chassis, for example a body, and a door which is pivotally mounted on the fixed chassis, and are pivoted together in such manner as to be capable of occupying either a folded position corresponding to the closure of the door, or an unfolded or deployed position corresponding to the opening of the door, one of the links being extended beyond the axis of its pivotal connection to the other link and forming a cam which, in the course of the unfolding of the toggle, cooperates with at least one element associated with the other link, in opposition to an elastically yieldable action, so as to produce a retention which may be overcome, also in opposition to the elastically yieldable action, to permit the return of the links to the folded position thereof.

In the German patent application No. 1,459,180 (Scharwächter) which discloses such a device, the cam which is carried by the extension of the link must pass, in the course of the opening movement, throughout, after having separated them, two elastically yieldable strips constituting the other link so as to be located, in the fully open position, beyond this link and thus create the desired retention. Consequently, the cam is formed on a cranked portion of the first link which projects, in a direction perpendicular to the line interconnecting the pivots of this link, to a considerable extent and therefore requires an opening in the body for receiving the end of this cranked portion.

An object of the present invention is to overcome this drawback while providing additional advantages.

According to the invention, there is provided a door stop device of the type mentioned hereinbefore, wherein said cam of the link is constituted by two semi-cams defining at least one stop notch each of which semi-cams cooperates with at least one cam follower located outside the other link and formed on a movable element carried by said other link and biased into contact with the semi-cams by an elastically compressed number which is also carried by the other link.

Owing to the fact that, on one hand, the elastically yieldable member or the two elastically yieldable members acting on the movable cam followers are mounted inside the same link, owing to a line of action well adapted to the linear shape of the link and that, on the other hand, the semi-cams of the first link cooperate with the cam followers located both in the region of and outside the other link, the device proposed by the invention consititues an assembly in one unit whose small overall size enables it to be placed in the fillister of the door with no need to notch the fixed chassis or the door itself. The device can therefore be easily mounted, for example by fixing on the body of a vehicle and on the door two forks on the branches of which forks the free end portions of the respective links are pivotally mounted. It is in particular possible to weld one of these forks carrying the whole of the device to the body and to bolt the other fork on the door when the latter is being placed in position.

One of the two pivot pins, or each one thereof, pivoting the link containing the elastically yieldable member or members (preferably constituted by compression springs) may serve as a support for one fixed end of the elastically yieldable member.

The link carrying the spring or springs and the cam followers is advantageously constructed in the form of a rigid U-section member or box-structure member having two opposed planar sides in sliding contact with flat sides of the associated link which has for this purpose a generally U-shape section. There may be formed in each one of these flat sides, which are symmetrical with respect to a plane perpendicular to the inner end of the U-shape section, an internal projection acting as a stop for the associated link and for the corresponding semi-cam which cooperates with the end portion, constituting a cam follower, of at least one rod which receives, in bearing relation thereto, a movable end of a spring and which extends through a guide slot formed in the corresponding lateral side of the other link.

Each of the links is advantageously produced by blanking, piercing and folding, or some other sheet steel blank forming operation.

Toward the end of the door opening movement, that is to say, during the unfolding or deployment of the toggle, each semi-cam engages the cam followers which thus exert a braking or retarding action preventing a brutal contact of abutment of the two links. In the final unfolded position of the toggle, the cam followers are engaged and retained in the stop notch or stop notches formed in each semi-cam. This stop notch, or these stop notches, have a contour which defines two divergent ramps along which ramps the compression of the spring or springs produces, through the cam followers, a braking or retarding action at the start of the closing movement of the door during which the toggle is folded.

Each semi-cam may be unilateral, that is to say, comprises a single stop notch for the fully open position and cooperate with a single cam follower carried by a movable rod which is biased by a single spring. The semi-cam may also be bi-lateral, that is to say have two stop notches for the fully open position with preferably a spear-head shape, in which case there are two conjugate cam followers formed on two movable rods which are biased by two springs mounted in opposition.

The invention will be explained in the course of the ensuing description with reference to the accompanying drawings in which.

Figure 1:
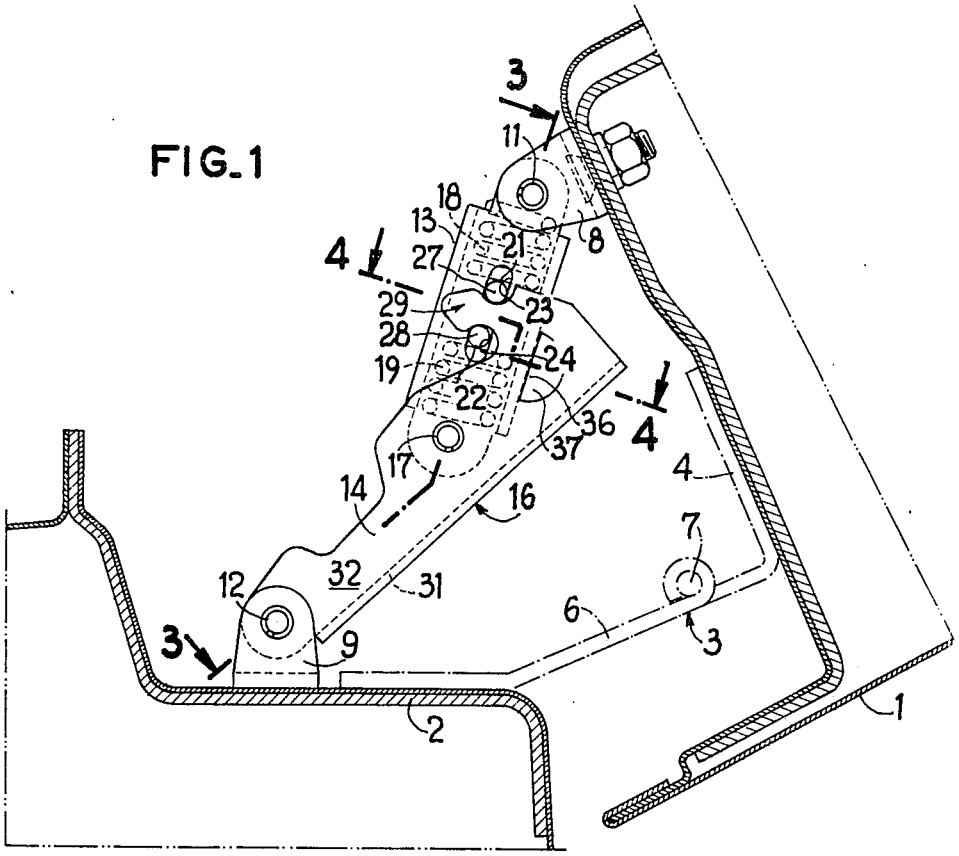
FIG. 1 is a view of a vehicle door equipped with a toggle-type door stop device, in the open position of the door and utilizing a bi-lateral cam in the shape of a spear head.
Figure 2:
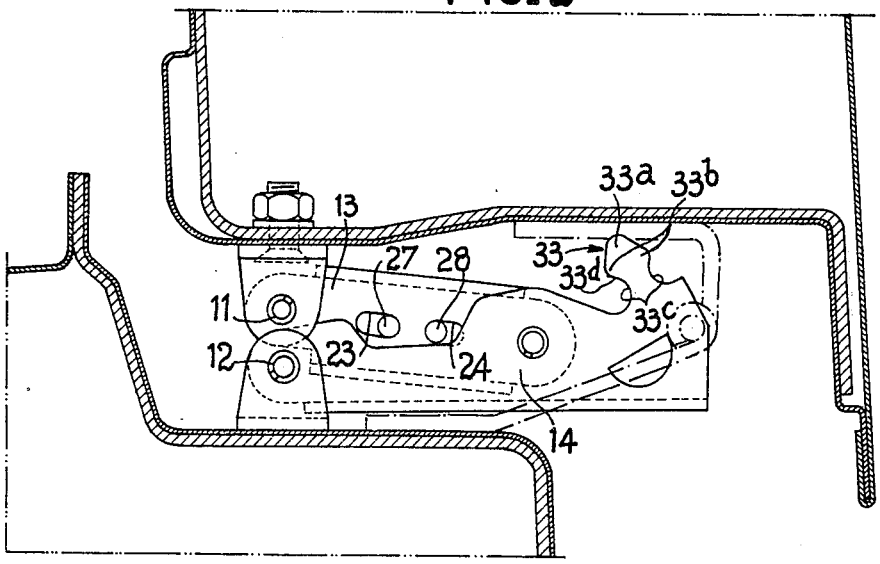
FIG. 2 is a corresponding view in the closed position of the door.
Figure 3:
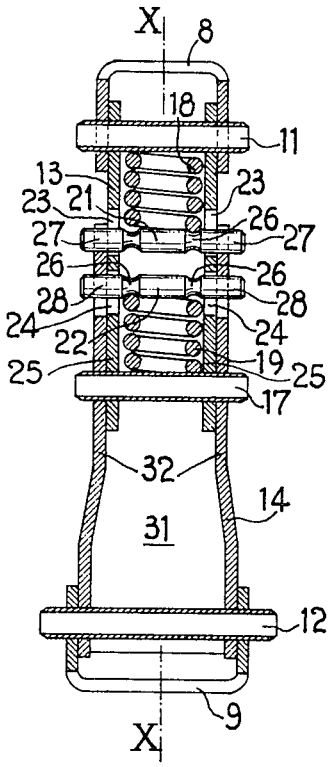
Figure 4:
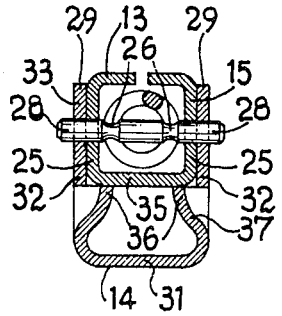
Figure 5:
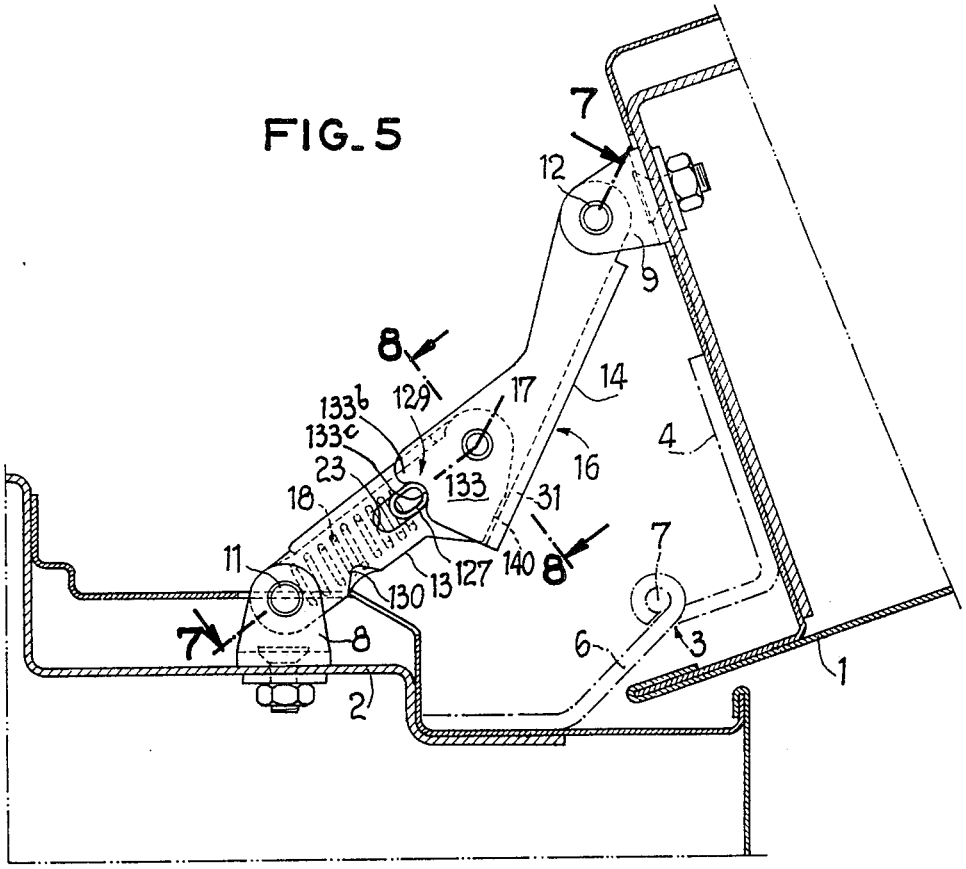
Figure 9:
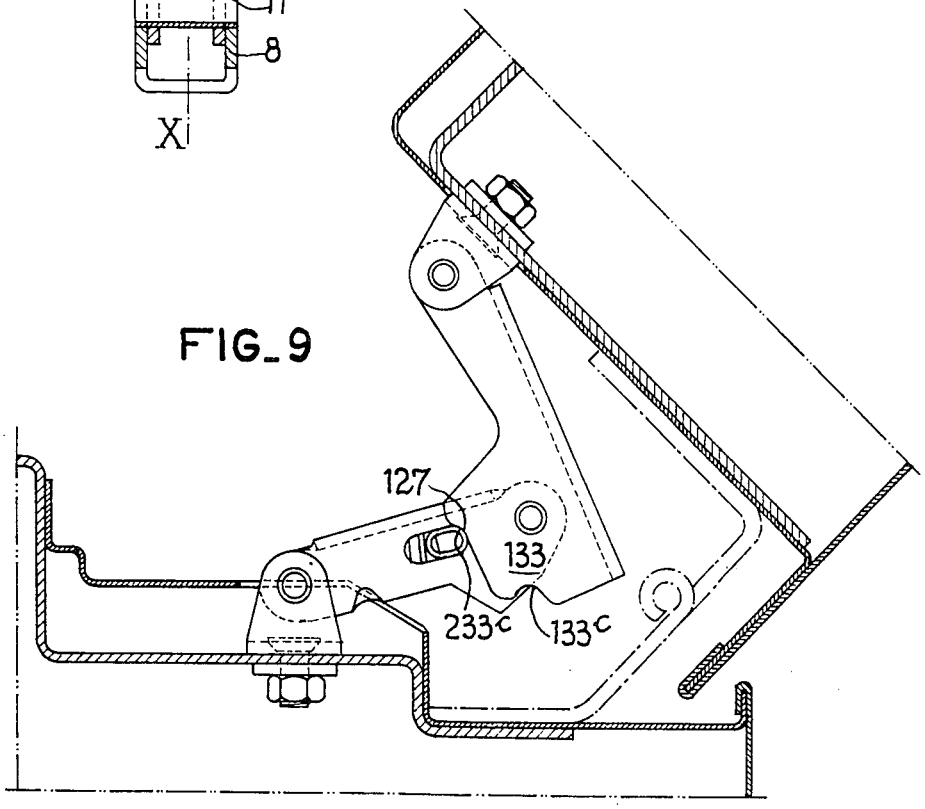

FIGS. 3 and 4 are sectional views taken on lines 3—3 and 4—4 respectively of FIG. 1;

FIGS. 5, 6, 7 and 8 are views corresponding to FIGS. 1, 2, 3 and 4 respectively, of a device employing a unilateral cam, and FIG. 9 is a view corresponding to FIG. 5 of a modification permitting a partial opening of the door.

The door stop device illustrated in the drawings is provided for retaining in its open position the door 1 of an automobile vehicle which is pivotally mounted on the box structure 2 of the body by means of two hinges 3 each comprising two hinge parts 4, 6 which are pivoted together by a pivot pin 7 and respectively secured to the door and to the box structure.

Mounted on each of these two parts of the vehicle is a double bracket or fork 8 or 9 in the branches of which fork 8 or 9 there is mounted a pivot pin 11 or 12 which is parallel to the hinge pin 7 and serves to mount the free end of the corresponding link 13 or 14 of a toggle. The folded and unfolded or deployed positions of the toggle correspond respectively to the closure (FIG. 2) and the fully open position (FIG. 1) of the door 1.

The link 13, which is pivoted to the link 14 by a pivot pin 17, has the general shape of a square-sectioned tube 15 having joined edges (FIG. 4) which is obtained by blanking and folding a sheet metal blank and inside which there are disposed two compression coil springs 18, 19 which are arranged in opposed relation. One of the ends of the spring 18 or 19 is fixed and bears against the adjacent pivot pin 11 or 17 of the link 13 and the other end of the spring 18 or 19 acts in contact with a cylindrical rod 21 or 22 which is parallel to the pins 11, 17 and extends through two guide slots 23 or 24 formed in each of the lateral sides 25 of the square-section tube 15. These rods, which are retained transversely by the cooperation of the adjacent end coil of the respective spring with two spaced-apart recesses 26 formed in each rod, extend beyond the faces of the square-section tube and form two pairs of circular followers 27, 28 which are engaged, near the end of the door opening movement, by a cam 29 in the shape of a spear head formed on a part of the link 15 which extends beyond the axis of the common pivot pin 17.

The link 14 has a U-shape section defining a flat transverse wall 31 and two side walls 32 which are symmetrical with respect to a plane X—X perpendicular to the inner wall of the U shape and to the pivot pins and are in sliding contact with the side faces 25 of the link 13. The cam 29 is divided into two semi-cams in the shape of a spear head 33 formed in the respective side walls of the U shape, the convergent point 33*a* of this spear head being inserted, at the end of the door opening movement, between two corresponding cam followers 27, 28 of the link 13 in urging them back, in opposition to the action of the compression of the springs, from their position of abutment in contact with the adjacent end of the guide slots 23, 24 until the two bosses 33*b* of the spear head have passed through the axis common to these two slots. The cam followers 37, 38 then enter, under the action of the springs, stop notches 33*c* formed in the region of the narrow part of the semi-cam at the base of the spear head and, simultaneously, an abutment edge 36 (FIG. 4), defined by a deformed portion 37 formed in each side wall of the link 14, is applied in the fully open position against an adjacent face 35 of the link 13 which is perpendicular to the lateral faces 25.

In the fully-open position, the unfolded or deployed toggle is retained by contact between each cam follower 27, 28 and the curved edge 33*b*, connected to the point of the spear head, of the corresponding stop notch. In order to overcome this retaining action due to the thrust exerted by the springs 18, 19 and close the door, an appropriate torque must be exerted on the latter.

Instead of being constructed by folding a sheet metal blank, the link 15 having the shape of a square-section tube could be obtained from a section of a closed tubular member having any sectional shape.

Figure 6:
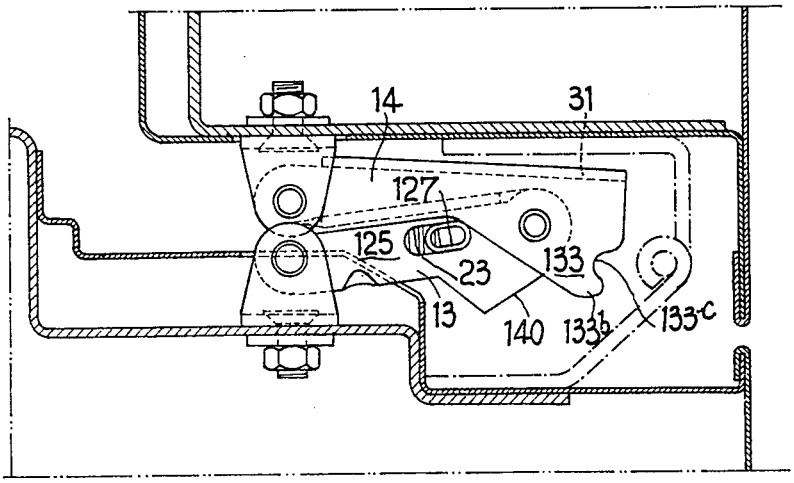
Figure 7:
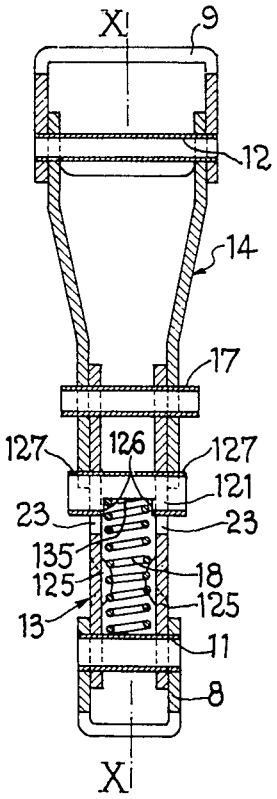
Figure 8:
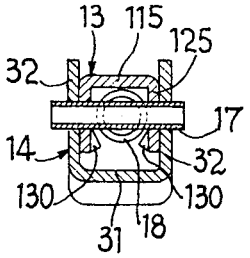

In the embodiment shown in FIGS. 5 and 6, the link 14 which carries the cam 129 is pivoted to the door 1, the other link 13 being pivoted to the base of the box structure of the body 2. The cam 129 instead of being in the shape of a spear head, that is to say bi-lateral as the cam 29, is unilateral in as much as each semi-cam 133 comprises a single boss 133*b* adjacent a concave stop notch 133 and it cooperates with a single cam follower 127 which is formed by a rod 121 in the corresponding end and projecting from the adjacent side wall 125 of the link 13. The rod 121 is in the shape of a flat tube and extends through the guide slots 23 of the side walls 125 and has parallel planar faces which are in sliding contact with the rectilinear edges of these slots. The spring 19 shown in FIGS. 1 to 5 is therefore eliminated and the spring 18 which is compressed between the pin 11 and the rod 121 is the sole spring provided.

The link 13 is constituted by a U-section member whose side walls 125 have on their free edge a projection 130 which is deformed inwardly for retaining the spring 18 in the direction perpendicular to the transverse wall of the U-section member. Moreover, the spring 18 and the rod 121 are retained laterally by shoulders 126 formed in a rectangular opening 135 which is formed in the centre of the rod and in which the spring bears.

In the fully-open position shown in FIG. 5, the toggle 16 is maintained unfolded or deployed by the engagement of each cam follower 27 in the stop notch 133*c* of the corresponding semi-cam 133, a rectilinear edge 140 of each side wall 125 of the link 13 being then in abutment with the transverse wall 31 of the U-section member with the transverse wall 31 of the U-section member constituting the link 14.

FIG. 19 shows a modification in which the semi-cam 133 of each side wall 32 of the link 14 is so shaped as to have not only a stop notch 133*c* defining the fully open position, but also an auxiliary stop notch 233*c* which corresponds to a partially open or parking position of the door.

Having now described our invention what we claim as new and desire to secure by Letters Patent is:

1. A toggle-type door stop device in particular for an automobile vehicle comprising two links for pivotally mounting respectively to a fixed part for example a body, and to a door which is pivotally mounted on the fixed part, the links being interconnected to pivot about a pivot axis so as to be capable of occupying selectively a folded position, corresponding to closure of said door, and an unfolded position corresponding to an opening of said door, a first of said links being extended beyond said pivot axis to form two semi-cams each of which defines at least one stop notch, cam follower means located outside the second of said links for cooperation with the stop notches of said semi-cams and movably mounted on said second link, elastically yieldable means carried by said second link and biasing said cam follower means into contact with said semi-cams, said semi-cams being capable of creating a retention in cooperation with said cam follower means when opening said links, said retention being capable of being overcome in opposition to the action of said elastically yieldable means for allowing said links to return to said folded position of said links.

2. A device as claimed in claim 1, wherein the elastically yieldable means are retained inside the second link and comprise a compression coil spring.

3. A device as claimed in claim 1, wherein the second link has two parallel planar faces and the first link has flat side walls which are in sliding contact with said planar faces.

4. A device as claimed in claim 1, wherein the first link has a U-shape section.

5. A device as claimed in claim 3, wherein the two semi-cams are formed in the respective side walls of the first link and disposed symmetrically with respect to a plane perpendicular to the said pivot axis.

6. A device as claimed in claim 3, wherein the second link has the shape of a tube.

7. A device as claimed in claim 3, wherein the second link has a U-shape section defining branches in which branches projections are provided for retaining the elastically yieldable means inside the U-shape section.

8. A device as claimed in claim 5, wherein the cam follower means is constituted by a rod and two guide slots formed in the lateral planar faces of the second link guidingly support said rod which extends beyond the lateral planar faces and forms two cam followers cooperative with said two semi-cams.

9. A device as claimed in claim 8, wherein said elastically yieldable means comprise at least one coil spring and the rod has two shoulders and the spring bears between the two shoulders.

10. A device as claimed in claim 3, comprising an abutment on each side wall of the first link against which abutments the second link is capable of bearing in the unfolded position of the links.

11. A device as claimed in claim 3, wherein the first link defines a planar face and each face of the second link defines a rectilinear edge adapted to abut against the planar face of the first link in the fully open position.

12. A device as claimed in claim 1, comprising adjacent a free end of each link a pivot pin and a fork which is pivotally mounted on the pivot pin and is provided for fixing to the door in respect of one link and to the fixed part in respect of the other link.

13. A device as claimed in claim 1, comprising a hinge for pivotally mounting the door on said fixed part, the hinge having two hinge parts to which the two links are respectively pivoted.

14. A device as claimed in claim 1, wherein each semi-cam is unilateral, that is to say defines a single stop notch pertaining to the fully open position and cooperates with the cam follower means in the form of a single cam follower biased by the elastically means which are in the form of a spring.

15. A device as claimed in claim 14, wherein each semi-cam has, in addition to the stop notch pertaining to the fully open position an auxiliary stop notch for cooperation with the cam follower in a partial opening of the links.

16. A device as claimed in claim 14, wherein the second link has two pivot pins for pivotally connecting it to the first link and pivotally connecting it to one of two elements consisting of said fixed part and said door, and the elastically yieldable element has a fixed end which is in bearing relation to one of said pivot pins.

17. A device as claimed in claim 1, wherein each semi-cam is bi-lateral that is to say, defines two stop notches pertaining to a fully open position and cooperates with said cam follower means which comprise two cam followers each of which cam followers is biased by the elastically yieldable means which are in the form of two springs each spring pertaining to a cam follower.

18. A device as claimed in claim 17, wherein each of said semi-cams is in the shape of a spear head.

19. A device as claimed in claim 17, wherein said second link has two pivot pins for pivotally connecting it to the first link and pivotally connecting it to one of two elements consisting of said fixed part and said door, said two springs being respectively in bearing relation to said pivot pins.

* * * * *